US010648131B2

(12) United States Patent
Redford

(10) Patent No.: US 10,648,131 B2
(45) Date of Patent: May 12, 2020

(54) METHODS OF PROCESSING PLANT FIBER, AND RELATED SYSTEMS AND COMPOSITIONS

(71) Applicant: POET Research, Inc., Sioux Falls, SD (US)

(72) Inventor: Steven G. Redford, Brandon, SD (US)

(73) Assignee: POET Research, Inc., Sioux Falls, SD (US)

( * ) Notice: Subject to any disclaimer, the term of this patent is extended or adjusted under 35 U.S.C. 154(b) by 986 days.

(21) Appl. No.: 14/699,357

(22) Filed: Apr. 29, 2015

(65) Prior Publication Data

US 2015/0315746 A1 Nov. 5, 2015

Related U.S. Application Data

(60) Provisional application No. 61/987,200, filed on May 1, 2014.

(51) Int. Cl.

| | |
|---|---|
| ***D21C 9/02*** | (2006.01) |
| ***D21C 11/00*** | (2006.01) |
| ***D21C 1/02*** | (2006.01) |

(52) U.S. Cl.

CPC ..... *D21C 9/02* (2013.01); *D21C 1/02* (2013.01); *D21C 11/00* (2013.01); *D21C 11/0028* (2013.01)

(58) Field of Classification Search

CPC .... D21C 9/02; D21C 9/04; D21C 9/06; D21F 5/185; D21F 5/187; D21F 5/20; D21F 5/18

USPC ..... 127/65

See application file for complete search history.

(56) References Cited

U.S. PATENT DOCUMENTS

| | | | | |
|---|---|---|---|---|
| 4,043,049 | A * | 8/1977 | Hedstrom | D21C 9/185 34/370 |
| 4,307,121 | A * | 12/1981 | Thompson | D21C 3/18 127/37 |
| 5,073,201 | A | 12/1991 | Giesfeldt et al. | |
| 5,112,638 | A | 5/1992 | Cagley et al. | |
| 6,147,206 | A | 11/2000 | Doner et al. | |
| 6,287,412 | B1 | 9/2001 | Giesfeldt et al. | |
| 6,388,110 | B1 | 5/2002 | Ulrich et al. | |
| 6,610,349 | B1 | 8/2003 | Delrue et al. | |
| 8,449,728 | B2 | 5/2013 | Redford | |
| 8,454,802 | B2 | 6/2013 | Redford | |
| 8,603,786 | B2 | 12/2013 | Redford | |
| 2003/0232109 | A1 | 12/2003 | Dawley et al. | |
| 2006/0216396 | A1 | 9/2006 | Abbas et al. | |
| 2011/0232853 | A1* | 9/2011 | Yin | D21C 11/0028 162/40 |

(Continued)

FOREIGN PATENT DOCUMENTS

| | | |
|---|---|---|
| FR | 2424030 | 11/1979 |

OTHER PUBLICATIONS

Smook, Handbook for Pulp and Paper Technologists, 1992, Angus Wilde Publications, 2nd edition, chapter 9.*

(Continued)

*Primary Examiner* — Anthony Calandra
(74) *Attorney, Agent, or Firm* — Kagan Binder, PLLC

(57) ABSTRACT

The present invention relates to plant fiber processes (e.g., washing, drying, and/or grinding) that utilize recycle and/or make-up streams to use water resources efficiently and/or produce intermediate and/or final products with desired properties.

18 Claims, 3 Drawing Sheets

(56) References Cited

U.S. PATENT DOCUMENTS

2012/0301597 A1 11/2012 Bootsma

OTHER PUBLICATIONS

Bakan et al., "Fungal Growth and Fusarium Mycotoxin Content in Isogenic Traditional Maize and Genetically Modified Maize Grown in France and Spain", J. Agric. Food Chem. 2002, 50, pp. 728-731.
Guevara et al., "Chemical Composition, in Vitro Fermentation Characteristics, and in Vivo Digestibility Responses by Dogs to Select Corn Fibers", J. Agric. Food Chem. 2008, 56, pp. 1619-1626.
Know Mycotoxins: published online Jan. 2010; http://web.archive.org/web/20100123141423/http://www.knowmycotoxins.com/regulations.htm (4 pages).
Item No. 4: Ten Tips for Streamlining Patent Prosecution: Published online Jun. 28, 2010; https://www.uspto.gov/blog/director/entry/ten_tips_for_streamlining_patent (3 pages).
FAO2: Mycotoxin Report published online at least by Nov. 2, 2006; http://www.fao.org/docrep/007/y5499e/y5499e07.htm (17 pages).
Texas A&M: Aflaguard: A Fungus for Biological Control of Aflatoxin Contamination of Corn; Plant Pathology and Microbiology; PLPA-FC004-2009; Prepared by Dr. Thomas Isakeit, Professor and Extension Plant Pathologist Texas AgriLife Extension Service; The Texas A&M University System, Jun. 2009 (1 page).
FAO: Maize in human nutrition; a book in English published 1992, also available in French and Spanish, available online at http://www.fao.org/docrep/T0395E/T0395E00.htm.
Hromádková et al., "Isolation and Characterization of Hemicelluloses of Corn Hulls", Chem. Papers 49(2) pp. 97-101 (1995).
Hofstetter et al., "Feed Quality and Animal Health: A Review from mycotoxin survey program", presented at VICTAM ASIA 2010, held at Queen Sirikit National Convention Center on Mar. 5, 2010 by Ursula Hofstetter: Director of Strategic Business Unit, Biomin, Austria (8 pages).
Binkerd et al., "Fumonisin contamination of the 1991 Indiana corn crop and its effects on horses", J Vet Diagn Invest 5, pp. 653-655 (1993).
Limay-Rios et al., "Development of an Integrated Mycotoxin Management System in Ontario Grains, Pillar I—Industry-Led Solutions to Emerging Issues", Prepared for: Agricultural Adaption Counsil's CanAdvance Program; Development of a Mycotoxin Management System (2010): Interim Report #1: Project ADV 0639 (35 pages).

* cited by examiner

METHODS OF PROCESSING PLANT FIBER, AND RELATED SYSTEMS AND COMPOSITIONS

PRIORITY CLAIM

The present non-provisional application claims the benefit of commonly owned provisional Application having Ser. No. 61/987,200, filed on May 1, 2014, which provisional application is incorporated herein by reference in its entirety.

BACKGROUND

Plants such as corn include a variety of constituents that can be used for many purposes. For example, starch obtained from corn plants can be used to make ethanol and plant fibers can be used as ingredients for a variety of products. Oftentimes it is desirable to separate the various plant constituents and purify them in an economical manner (e.g., energy efficient manner, environmentally friendly manner, and the like), while at the same time providing desired properties in the intermediate and/or final plant material products.

Accordingly, there is a continuing need to improve processes for treating plant materials such as plant fibers in an economical manner while at the same time providing desirable properties in the intermediate and/or final products.

SUMMARY

The present invention involves methods and systems that selectively adjust the amount of make-up aqueous stream(s) and recycled aqueous stream(s) that are used for washing plant fiber depending on the desired level of fiber purity so as to use water more efficiently.

According to one aspect of the present invention, a method of cleaning plant fiber includes: a) providing a first plant fiber component including plant fiber and one or more additional plant constituents; b) combining the first plant fiber component with at least a first aqueous component comprising water and at least a portion of the one or more additional plant constituents to form a first mixture including: i) a second plant fiber component including plant fiber and one or more additional plant constituents; and ii) a second aqueous component including water and one or more additional plant constituents; c) separating at least a portion of the second aqueous component from the first mixture; d) after step (c), combining the first mixture with at least a third aqueous component including water to form a second mixture including: i) a third plant fiber component including plant fiber; and ii) the first aqueous component; e) separating the first aqueous component from the second mixture; and f) recycling at least a portion of the first aqueous component so that it can be combined with the first plant fiber component, wherein the concentration of plant fiber on a dry matter basis in the third plant fiber component is greater than the concentration of plant fiber on a dry matter basis in the first plant fiber component.

According to another aspect of the present invention, a system for cleaning plant fiber includes: a) a first plant fiber component source including plant fiber and one or more additional plant constituents; b) a first aqueous component source including water and at least a portion of the one or more additional plant constituents; c) a first vessel in fluid communication with the first plant fiber component source and the first aqueous component source to combine the first plant fiber component with the first aqueous component to form a first mixture including: i) a second plant fiber component including plant fiber and one or more additional plant constituents; and ii) a second aqueous component including water and one or more additional plant constituents; d) a first separation apparatus in fluid communication with the first mixture to separate at least a portion of the second aqueous component from the first mixture; e) a second vessel in fluid communication with the first mixture from the first separation apparatus and a third aqueous component source including water to combine the first mixture with the third aqueous component to form a second mixture including: i) a third plant fiber component including plant fiber; and ii) the first aqueous component; f) a second separation apparatus in fluid communication with the second mixture to separate the first aqueous component from the second mixture; and g) a recycle line in fluid communication with the second separation apparatus and the first vessel to provide at least a portion of the first aqueous component to the first vessel, wherein the concentration of plant fiber on a dry matter basis in the third plant fiber component is greater than the concentration of plant fiber on a dry matter basis in the first plant fiber component.

The present invention also involves methods and systems that can process a plant fiber to produce a fiber product (e.g., ground corn bran fiber) having a desired moisture level using recycle and make-up air streams.

According to another aspect of the present invention, a method of processing a plant fiber includes: a) providing a plant fiber component including plant fiber, wherein the plant fiber component has an amount of moisture; b) processing the plant fiber component to provide a fiber product, wherein the plant fiber component is processed at a temperature that can reduce the amount of moisture in the plant fiber component; c) combining the plant fiber component with a first gas stream having a temperature and humidity value to control the moisture content of the fiber product; d) after said processing, separating at least a portion of gas from the fiber product to form a recycled gas stream; and e) using the recycled gas stream to form the first gas stream.

According to yet another aspect of the present invention, a system for processing a plant fiber includes: a) a plant fiber component source including plant fiber, wherein the plant fiber component has an amount of moisture; b) a grinding apparatus in fluid communication with the plant fiber component source to grind the plant fiber and produce a fiber product, wherein the plant fiber component is exposed to a temperature in the grinding apparatus that can reduce the amount of moisture in the plant fiber component; c) a first gas stream in fluid communication with the grinding apparatus, wherein the first gas stream can be combined with the plant fiber component, and wherein the first gas stream has a temperature and humidity value to control the moisture content of the fiber product; and d) a separation apparatus in fluid communication with the grinding apparatus, wherein the separation apparatus is configured to separate at least a portion of the first gas stream from the fiber product to form a recycled gas stream, wherein the recycled gas stream is in fluid communication with the first gas stream so that the recycled gas stream can be used to form the first gas stream.

DETAILED DESCRIPTION

Methods and systems are described in detail herein below for processing plant fiber according to the present invention.

A wide variety of plant fibers can be processed according to the present invention. In some embodiments, plant fibers include grain fibers obtained from plants such as fibers from corn, sorghum, barley, oats, wheat, and the like. For example, a preferred plant fiber includes corn bran fiber obtained from one or more fractionation processes such as those used to make ethanol from corn grain. Fractionating corn grain to make ethanol is well-known and is described in, e.g., U.S. Pat. Nos. 8,454,802 (Redford); 8,449,728 (Redford); and 8,603,786 (Redford), wherein the entirety of each patent is incorporated herein by reference for all purposes. Corn bran fiber obtained from a fractionation process may include one or more additional materials such as additional plant constituents (e.g., starch). It may be desirable to remove such additional materials from corn bran fiber so as to purify and increase the content of the corn bran fiber.

One aspect of the present invention involves washing a plant fiber to clean the plant fiber and increase the purity of the plant fiber. For example, as discussed above, plant fiber can have other materials such as plant constituents (e.g., starch) bound to the fiber. A method of removing a plant constituent such as starch from plant fiber according to the present invention can selectively adjust the amount of make-up water and recycled water that are used for cleaning the plant fiber depending on the desired level of fiber purity so as to use water more efficiently.

An exemplary method and system 100 for washing a plant fiber according to the present invention will be described with respect to FIG. 1 in the context of removing starch from corn bran fiber to increase the level of fiber while using water in an efficient manner.

Figure 1A:
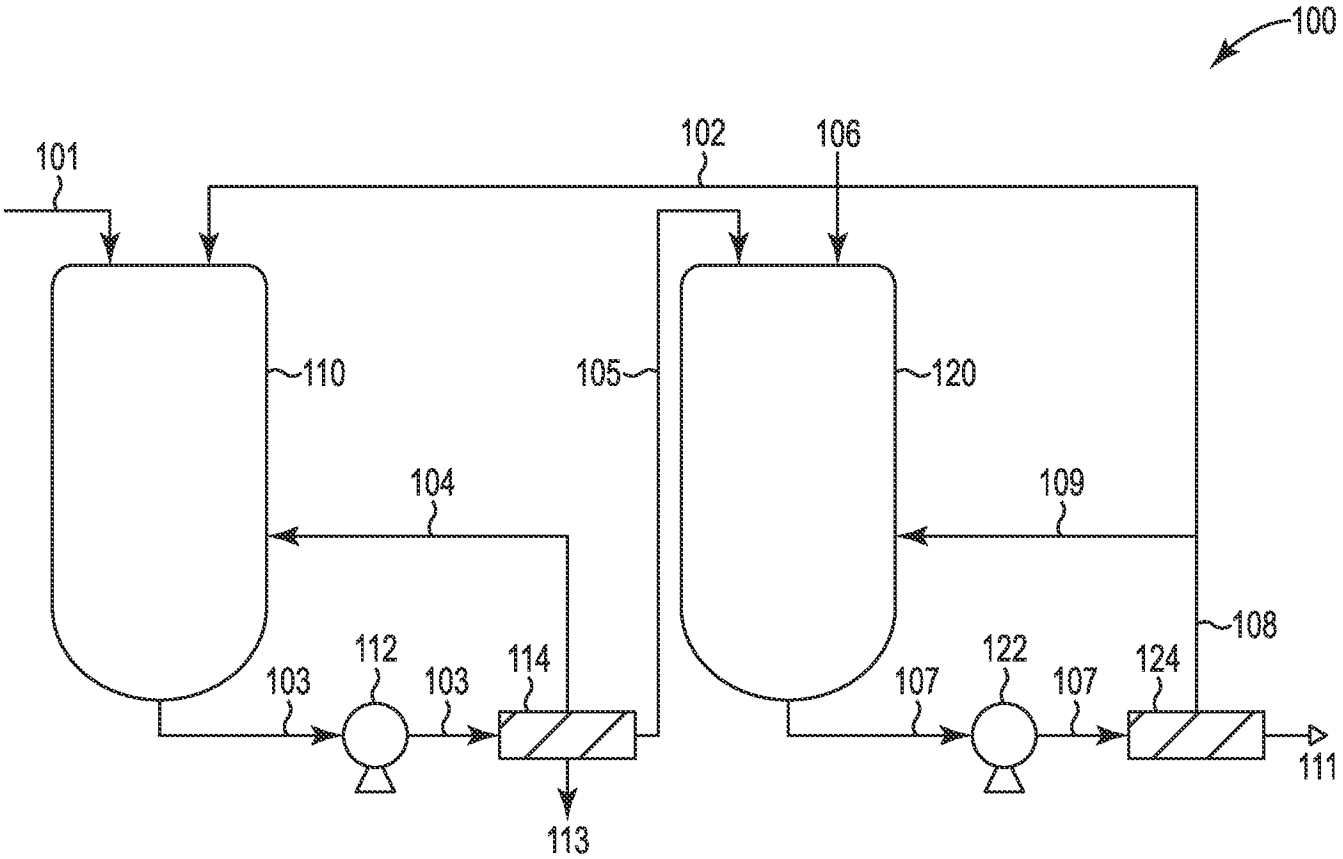
FIG. 1A is a process flow diagram illustrating an exemplary method and system for washing a corn bran fiber according to the present invention.

As shown in FIG. 1A, a crude corn bran fiber stream (i.e., a "fiber component") 101 is provided to a vessel such as tank 110. Crude stream 101 can be obtained from a corn fractionation process used to make ethanol. The crude corn bran fiber stream 101 includes at least residual starch from the corn fractionation process. Much of the starch is still bound to the corn bran fiber.

Aqueous steam 102 is also provided to tank 110 and combined with corn bran fiber stream 101 to form a mixture and help wet the corn bran fiber so that the starch can be more easily separated from the corn bran fiber. Aqueous stream 102 is preferably a recycle stream that includes water and one or more other materials separated from the corn bran fiber (e.g., soil, starch, and the like).

Tank 110 is maintained at appropriate conditions to facilitate wetting of the corn bran fiber and to help separate at least some of the starch from the bran fiber. For example, in some embodiments, tank 110 can use agitation (e.g., stirring) to help wet and wash the starch from the bran fiber. Also, the contents of tank 110 can be heated (e.g., via heating tank 110 and/or heating stream 102) to help remove starch from the corn bran fiber.

After processing the corn bran fiber in tank 110 for an appropriate amount of time, the mixture is pumped via line 103 so that at least a portion of the aqueous fraction of the mixture can be separated from the mixture. Because at least some washing occurs in tank 110, the aqueous fraction of the mixture in line 103 tends to include relatively higher levels of washed materials (e.g., starch) as compared to aqueous stream 102 and the corn bran fiber tends to be relatively more clean as compared to the raw corn bran fiber in stream 101. In some embodiments, an apparatus can be used to apply pressure to the mixture so as to separate at least a portion of the aqueous fraction from the mixture. Also, applying pressure can help abrade the corn bran fiber and separate material such as starch from the corn bran fiber. As shown, the mixture is pumped via pump 112 to screw press 114. At least a portion of the aqueous fraction of the mixture that is separated via screw press 114 can be recycled to tank 110 via line 104 and another portion of the aqueous fraction of the mixture that is separated via screw press 114 can be removed from the washing process 100 via line 113.

The aqueous fraction of the mixture that removed from the washing process 100 via line 113 can be handled in a variety of ways. In some embodiments, it can be discharged to waste or delivered to another process. For example, because the aqueous stream in line 113 can include starch separated from corn bran fiber, the starch in line 113 can be delivered to a fermentation process and fermented into ethanol.

After screw press 114, the corn bran fiber is delivered to at least one additional vessel such as tank 120 so that an additional washing process can be performed with an aqueous stream that is different from stream 102. As shown, aqueous stream 106 is delivered to tank 120 and is combined with the corn bran fiber from stream 105 to form a mixture and help wet the corn bran fiber so that at least some of the remaining starch can be more easily separated from the corn bran fiber. Preferably, aqueous stream 106 includes fresh clean water added to the system 100 (i.e., "make-up" water).

Tank 120 is maintained at appropriate conditions to facilitate wetting of the corn bran fiber and to help separate at least some of the remaining starch from the bran fiber. For example, in some embodiments, tank 120 can use agitation (e.g., stirring) to help wet and wash starch from the bran fiber. Also, the contents of tank 120 can be heated (e.g., via heating tank 120 and/or heating line 106 and/or heating line 105) to help remove starch from the corn bran fiber. Preferably, tank 120 is substantially the same as tank 110.

After processing the corn bran fiber in tank 120 for an appropriate amount of time, the mixture is pumped via line 107 so that preferably as much of the aqueous fraction of the mixture can be separated from the mixture to create an aqueous stream 108 and a fiber stream 111. Because at least some washing occurs in tank 120, the aqueous fraction of the mixture in line 107 tends to include relatively higher levels of washed materials (e.g., starch) as compared to aqueous stream 106 and the corn bran fiber in line 111 tends to be relatively more clean as compared to the corn bran fiber in stream 105. In some embodiments, an apparatus can be used to apply pressure to the mixture so as to help separate an aqueous fraction from the mixture. Also, applying pressure can help abrade the corn bran fiber and separate material such as starch from the corn bran fiber. As shown, the mixture is pumped via pump 122 to screw press 124 in a manner similar to screw press 114 (discussed above). At least a portion of the aqueous stream 108 that is separated via screw press 124 can be recycled to tank 120 via line 109 and another portion of the aqueous fraction of the mixture that is separated via screw press 124 can be recycled to tank 110 via line 102.

The flow rates of the recycle streams and fresh/discharge streams in process 100 can be adjusted to impact the fiber purity level as desired in stream 111, while at the same time taking into account the amount of fresh ("make-up") water used. In some embodiments, the concentration of fiber in tanks 110 and 120 can be kept constant so as to provide a desired residence time for the fiber to be exposed to washing action. In such embodiments, as the flow rate of fresh water 106 is increased, the purity of fiber in stream 111 is increased. For example, if a relatively higher level of fiber purity is desired in stream 111, then the flow rate of fresh water introduced into process 100 via line 106 can be increased, which corresponds to an increase in flow rate of lines 102 and 113. As a result, the flow rates of the recycle streams such as streams 104 and 109 can be reduced to maintain the appropriate concentrations in each of tanks 110 and 120. As another example, if a relatively lower fiber purity can be tolerated, the flow rate of fresh water introduced into process 100 via line 106 can be reduced, thereby saving on the amount of fresh water used as well as reducing the amount of water discharged via line 113. In such a scenario, the flow rate of line 102 can also be reduced (and be almost the same as the flow rate of line 106) while the flow rates of the recycle streams 104 and 109 can be increased to accommodate the reduced flow rate in line 106 and maintain the appropriate concentrations in each of tanks 110 and 120.

Fiber stream 111 can be further processed as desired. For example, fiber stream 111 can be ground as described below in connection with FIG. 2. The fiber cleaning process 100 cleans the corn bran fiber delivered in stream 101 such that the purity or concentration of fiber on a dry matter basis in stream 111 is higher as compared to the concentration of fiber on a dry matter basis in stream 101. In some embodiments, the concentration of fiber in stream 111 is 80 percent or greater on a dry matter basis, preferably 85 percent or greater on a dry matter basis, even 90 percent or greater on dry matter basis.

Figure 1B:
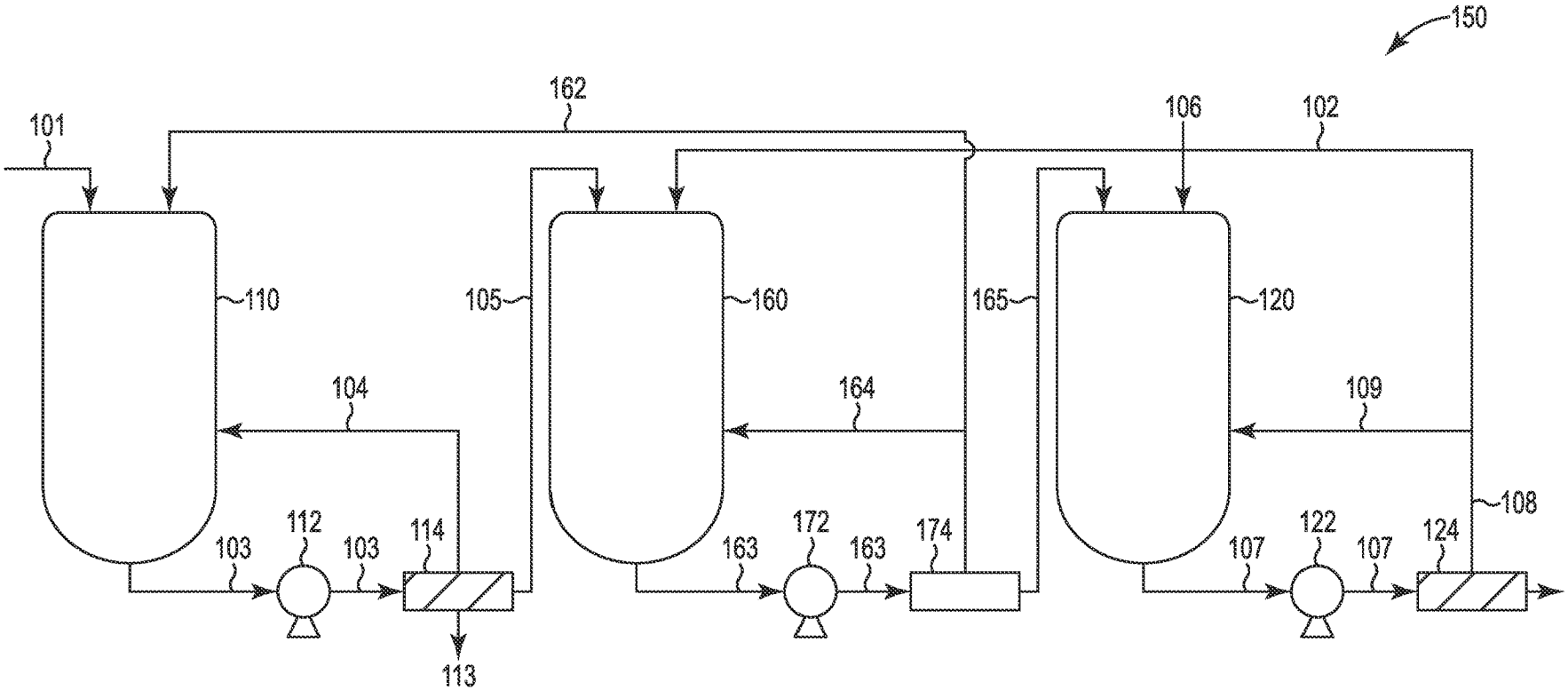
FIG. 1B is a process flow diagram illustrating an exemplary alternative of the method and system shown in FIG. 1A for washing a corn bran fiber according to the present invention.

Optionally, the process 100 in FIG. 1A can be modified to include one or more additional washing vessels between tanks 110 and 120. Such additional washing vessels could include recycle and/or fresh water streams to help wash the fiber in a manner as described above with respect to tanks 110 and 120. Also optionally, such additional washing vessels could include one or more separating apparatuses (e.g., screw presses) between each washing vessel so as to separate an aqueous fraction from the fiber before delivering the fiber to the next washing vessel. In some embodiments, including additional washing vessels and maintaining similar concentrations as in the two tank system described in FIG. 1A (to provide appropriate residence times) can permit less fresh water to be used for a given fiber purity as compared to the two tank system in FIG. 1A. For example, an alternative process 150 is shown in FIG. 1B, where the same reference characters have been used for similar features as described in FIG. 1A (a discussion of those same reference characters is not repeated for FIG. 1B). Process 150 includes an additional wash tank 160. Process 150 is set up with recycle streams and a fresh water stream 106 such that the fresh water is used to wash the cleanest fiber in process 150, which is in the last tank 120, and the relatively most unclean recycle water in stream 162 is used to wash the incoming fiber from stream 101, which is typically the most unclean fiber in process 150. As mentioned above, because a third wash tank 160 is introduced and the same concentration is used for tanks 110, 120, and 160 as in FIG. 1A, a lower flow rate for fresh water stream 106 can be used while at the same time producing the same level of fiber purity as compared to the system in FIG. 1A, which would use a higher flow rate for fresh water line 106. In a preferred embodiment, as shown in FIG. 1B, a screw press is used at least for the first and last wash tanks (i.e., tanks 110 and 120). Using a screw press 114 for the first wash tank helps abrade and scrap starch that may be bound to the fiber so as to loosen such starch and permit it to be washed in a subsequent wash tank such as tank 160 and/or tank 120. Using a screw press after the last tank such as screw press 124 after tank 120 helps permit a relatively high amount of wash water to be separated from the fiber. Separating a relatively high amount of wash water from fiber after the last wash tank can be advantageous as it can lower the amount of water that needs to be removed in a downstream drying apparatus, which can save on energy costs. After washing in tank 160, the mixture of at least fiber, starch, and water is pumped from tank 160 to a separation apparatus 174 via pump 172 and line 163. Separation apparatus 174 permits an aqueous stream to be recovered for use as recycled wash water in lines 162 and 164. In some embodiments, separation apparatus 174 can include a screw press, especially if fiber abrasion is desired. The fiber stream 165 can be delivered to tank 120 and treated as discussed above with respect to FIG. 1A.

Optionally, the processes 100 and 150 shown in FIGS. 1A and 1B can include processing steps and equipment known in the fiber processing art to facilitate cleaning and/or maintaining appropriate cleaning conditions such as filters, cyclone separators, heat exchangers, pumps, and the like.

Another aspect of the present invention involves processing a plant fiber to produce a fiber product (e.g., ground corn bran fiber) having a desired moisture level. For example, after washing corn bran fiber, it can be ground into a fiber product. Typically, the corn bran fiber is sufficiently dried before grinding so that the fiber can be handled in an efficient manner. If the corn bran fiber has too high of a moisture level, it can be difficult to handle and process. Oftentimes, the grinding process occurs at a temperature to inhibit bacterial growth in the grinding and related equipment as well as the final product. Such elevated temperatures can further dry the fiber to an undesirably low moisture level. A method of processing (e.g., grinding) a corn bran fiber according to the present invention can selectively adjust the flow rate of one or more recycled gas streams as well as the humidity, flow rate, and temperature of a fresh gas stream to create a combined gas stream that is exposed to the corn bran fiber during such processing so as to provide a desired moisture level in the final corn bran product.

Figure 2:
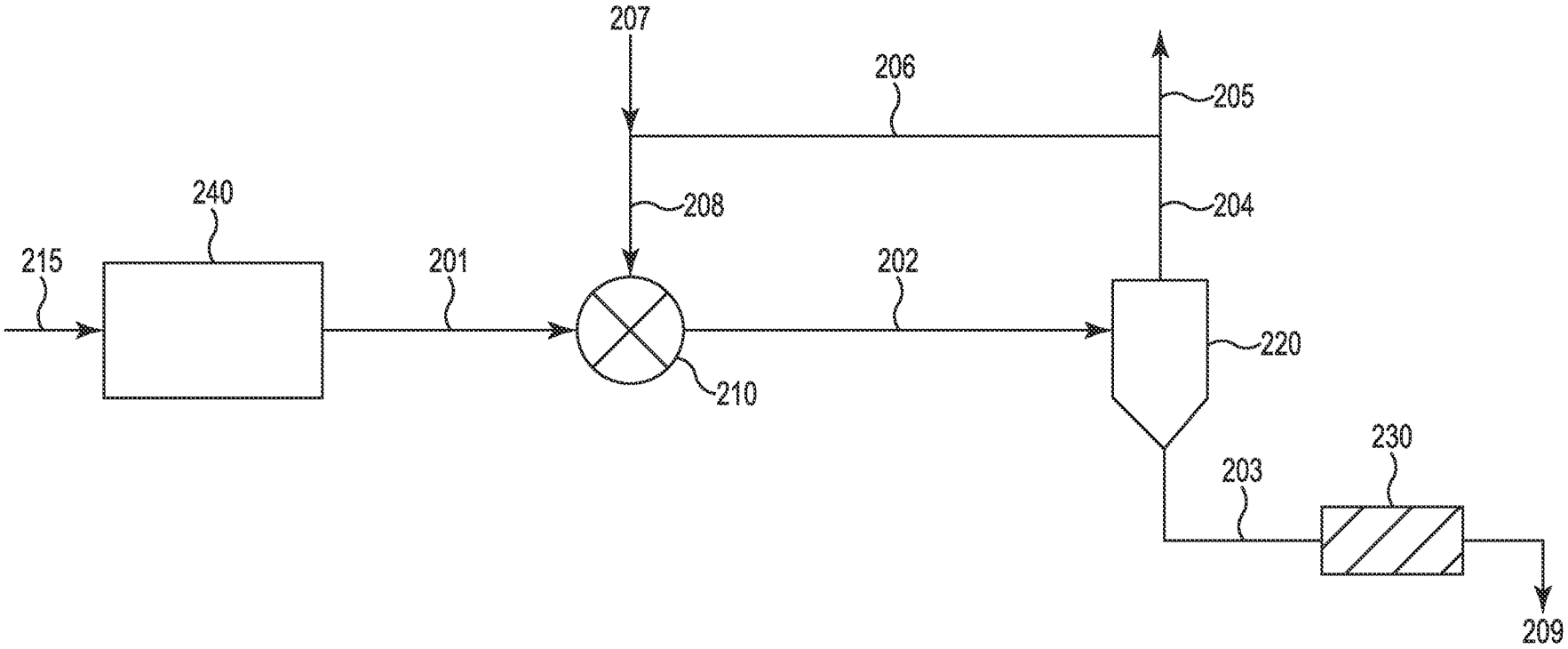
FIG. 2 is a process flow diagram illustrating an exemplary method and system for grinding a corn bran fiber to produce a corn bran fiber product according to the present invention.

An exemplary method and system 200 for processing a plant fiber according to the present invention is described with respect to FIG. 2 in the context of grinding corn bran fiber to produce a ground corn bran fiber product having a desired moisture level.

As shown in FIG. 2, a stream of corn bran fiber 201 is delivered to a grinding apparatus 210 to reduce the size of the corn bran fiber to form a ground corn bran fiber stream 202. After grinding the corn bran fiber in mill 210, the ground corn bran fiber is transferred to separator 220 (e.g., a cyclone separator) to separate gas from the ground corn bran fiber. The gas is removed from the top of separator 220 via line 204 and the ground corn bran fiber leaves separator 220 through the bottom via line 203. Gas stream 204 can be split into gas stream 205 (e.g., a gas exhaust) and recycled gas stream 206, which are discussed in detail below. The ground corn bran fiber stream 203 can optionally be cooled via cooling apparatus 230 and packaged as a ground fiber product via line 209. The process in FIG. 2 is controlled to produce a ground corn bran fiber product in stream 209 to have a desired moisture content, which is typically below 12 percent so that the fiber product can be stored without being susceptible to mold growth. In some embodiments, the ground corn bran fiber product in stream 209 has a moisture content in the range of from 2 to 10 percent.

The corn bran fiber in stream 201 typically has a moisture content before grinding. If the moisture level is too high, the fiber can become difficult to handle and process. In some embodiments, the stream of corn bran fiber 201 can be provided from a bran washing process, such as stream 111 discussed above with respect to FIG. 1A. Optionally, as shown in FIG. 2, a corn bran fiber in stream 215 can be dried to the desired moisture content in dryer 240 prior to providing the stream 201 to grinding apparatus 210. In some embodiments that include a dryer such as dryer 240 it can be desirable to dry the fiber so that it can at least be handled and processed. Removing more moisture than is necessary for the fiber to be handled and processed can add extra cost without necessarily providing a benefit. Accordingly, in some embodiments, the fiber in stream 201 can be as moist as possible as long as the fiber can be handled and is not prone to microbial growth. In some embodiments, the moisture content of the fiber in stream 201 is no more than 12 percent, preferably 10 percent or less.

Grinding apparatuses are well-known and include, e.g., mills, etc. Grinding apparatus 210 can be maintained at conditions to facilitate reducing the size of the corn bran fiber in stream 201. In addition, the grinding apparatus 210 can be operated at a temperature that inhibits the growth of bacteria in the process equipment (e.g., grinding apparatus 210 and separator 220) as well as the ground fiber. Exemplary temperatures include at least 130° F., preferably at least 135° F. (e.g., from 130° F. to 170° F.). Such temperatures can reduce the moisture level of the corn fiber product 202 as compared to the corn bran fiber 201 entering the grinding apparatus 210. Higher temperatures can be tolerated as long as the quality of the ground fiber and/or process equipment is not impacted to an undue degree. In some embodiments, the grinding process can operate at a temperature of 250° F. or less.

To help provide the ground fiber product in stream 209 with a desired moisture content (e.g., from 2-10 percent) the humidity and temperature of the incoming gas stream 208 are controlled. The humidity and temperature of gas stream 208 can be controlled using a combination of one or more of exhaust stream 205, recycle gas stream 206, and make-up (e.g., fresh) gas stream 207. Controlling gas stream 208 in such a manner can advantageously produce a relatively quick response in moisture content of the ground fiber product in stream 209. Also, controlling gas stream 208 in such a manner can provide desirable quality control of the moisture content in the ground fiber product. In embodiments that dry the fiber stream (e.g., via dryer 240) before it is provided to a grinding apparatus, the dryer can be used as a coarse adjustment for the moisture content of the fiber in stream 201 and gas stream 208 can be used as a fine adjustment to the moisture content of the fiber so as to provide the desired moisture content of the fiber in stream 209.

In some embodiments, the humidity and temperature of gas stream 208 are such that moisture is transferred out of the fiber coming in from stream 201 (i.e., the fiber in stream 201 is dried) so as to provide the desired moisture content in the ground fiber in stream 209. In other embodiments, the humidity and temperature of gas stream 208 are such that moisture content of the fiber coming in from stream 201 is maintained through to stream 209 so as to provide the desired moisture content in the ground fiber in stream 209. In still other embodiments, the humidity and temperature of gas stream 208 are such that moisture is transferred into the fiber coming in from stream 201 (i.e., the fiber in stream 201 is moistened) so as to provide the desired moisture content in the ground fiber in stream 209. If moisture is transferred into the fiber that is provided in stream 201, the humidity and temperature of gas stream 208 are preferably selected so as to avoid condensation on process equipment (e.g., apparatus 210 and separator 220) and thereby reduce the chance for microbial growth.

The temperature and humidity of stream 208 can be controlled by selectively controlling at least the flow rates of gas streams 206 and 205. Gas stream 206 is a recycled gas stream from the gas stream 204 leaving separator 220. Gas stream 205 is an exhaust stream that can be used to throttle the flow of stream 206 as necessary to control the temperature and humidity of stream 208. For example, if the moisture level of the fiber product in stream 209 is too high, then the flow rate of exhaust stream 205 can be increased. Optionally, make-up gas (e.g., air) stream 207 can be provided at a desired temperature and humidity and combined with recycled gas stream 206. For example, if the fiber product in stream 209 is too dry and the temperature in grinding apparatus 210 is too high, then fresh humid air can be supplied via stream 207 and combined with recycled air stream 206 before being supplied to grinding apparatus 210. As yet another example, if the moisture level of the fiber product in stream 209 is too high, then heated fresh air can be supplied via stream 207 and combined with recycled air stream 206 before being supplied to grinding apparatus 210.

As mentioned, the temperature of gas stream 208 is controlled to a temperature depending on the desired moisture content of the ground fiber in stream 209. Exemplary temperatures for gas stream 208 include a temperature in the range of from 130 F to 170° F. As also mentioned, the humidity of gas stream 208 is controlled to a humidity level depending on the desired moisture content of the ground fiber in stream 209

The temperature of make-up air stream 207 can be adjusted by techniques known in the art such using heating coils, cooling coils, combinations of these, and the like. The humidity of make-up air stream 207 can be adjusted using humidifying equipment and/or de-humidifying equipment, both of which are well known. Steam injection can also be used to adjust both temperature and humidity.

Exemplary corn bran fiber products in stream 209 can include at least 80 percent fiber on a dry matter basis, preferably at least 85 percent fiber on a dry matter basis, and even more preferably at least 90 percent fiber on a dry matter basis.

What is claimed is:

1. A method of cleaning plant fiber comprising:

a) providing a first plant fiber stream comprising grain fiber and one or more additional plant constituents including starch;

b) combining the first plant fiber stream with at least a first aqueous stream comprising water and one or more additional plant constituents to form a first mixture in a first tank, wherein the first mixture is subjected to agitation in the first tank;

c) providing the first mixture to a first separation apparatus;

d) separating a second aqueous stream from the first mixture in the first separation apparatus to form a second plant fiber stream comprising grain fiber;

e) recycling at least a first portion of the second aqueous stream so that it can be combined with the first plant fiber stream in the first tank;

f) after step (d), combining the second plant fiber stream with make-up water to form a second mixture in a second tank, wherein the second mixture is subjected to agitation in the second tank;

g) providing the second mixture to a second separation apparatus;

h) separating a third aqueous stream from the second mixture in the second separation apparatus to form a third plant fiber stream comprising grain fiber;

i) separating a first portion from the third aqueous stream and recycling the first portion so that it can be combined with the second plant fiber stream in the second tank;

j) separating a second portion from the third aqueous stream and recycling the second portion to form the first aqueous stream so that it can be combined with the first plant fiber stream in the first tank; and k) adjusting a flow rate of the make-up water to adjust the concentration of grain fiber on a dry matter basis in the third plant fiber stream, wherein the concentration of plant fiber on a dry matter basis in the third plant fiber stream is greater than the concentration of plant fiber on a dry matter basis in the first plant fiber stream, and wherein the second aqueous stream is not combined with the second portion of the third aqueous stream at least prior to the separating the second portion from the third aqueous stream.

2. The method of claim 1, wherein the grain fiber comprises corn bran fiber.

3. The method of claim 1, wherein step (d) comprises subjecting the first mixture to pressure to separate the second aqueous stream from the first mixture and/or step (h) comprises subjecting the second mixture to pressure to separate the third aqueous stream from the second mixture.

4. The method of claim 1, further comprising combining the first mixture with one or more additional aqueous streams before combining the second plant fiber stream with the make-up water and the first portion of the third aqueous stream to form the second mixture.

5. The method of claim 1, wherein the grain fiber in the third plant fiber stream has an amount of moisture; and further comprising:

a) providing the third plant fiber stream to a grinding apparatus and grinding the grain fiber in the third plant fiber stream;

b) combining the third plant fiber stream with a first gas stream having a temperature and humidity value to control the moisture content and temperature of the grain fiber in the third plant fiber stream during the grinding;

c) after said grinding, separating at least a portion of gas from the third plant fiber stream to form a recycled gas stream and a fiber product stream; and d) using the recycled gas stream to form the first gas stream.

6. The method of claim 5, wherein the first gas stream is at a temperature that inhibits bacteria in the plant fiber.

7. The method of claim 6, wherein the first gas stream is at a temperature of 135 degrees F. or greater.

8. The method of claim 5, further comprising combining the recycled gas stream with a second gas stream having a temperature and a humidity value to form the first gas stream.

9. The method of claim 5, wherein the fiber product has a moisture content less than 12 percent.

10. The method of claim 5, wherein the plant fiber in the third plant fiber stream is dried prior to step (a) to have the amount of moisture.

11. The method of claim 5, wherein the third plant fiber stream is combined with the first gas stream so that the fiber product in the fiber product stream has substantially the same moisture content as the plant fiber in the third plant fiber stream prior to step (a).

12. The method of claim 5, wherein the third plant fiber stream is combined with the first gas stream so that the fiber product in the fiber product stream has a lower moisture content than the plant fiber in the third plant fiber stream prior to step (a).

13. The method of claim 5, wherein the third plant fiber stream is combined with the first gas stream so that the fiber product in the fiber product stream has a higher moisture content than the plant fiber in the third plant fiber stream prior to step (a).

14. The method of claim 1, wherein at least a second portion of the second aqueous stream is not returned to a washing process.

15. A method of cleaning plant fiber comprising:

a) providing a first plant fiber stream comprising a grain fiber and one or more additional plant constituents including starch;

b) combining the first plant fiber stream with at least a first aqueous stream comprising water and one or more additional plant constituents to form a first mixture in a first tank, wherein the first mixture is subjected to agitation in the first tank;

c) providing the first mixture to a first separation apparatus;

d) separating a second aqueous stream from the first mixture in the first separation apparatus to form a second plant fiber stream comprising grain fiber;

e) recycling at least a first portion of the second aqueous stream so that it can be combined with the first plant fiber stream in the first tank;

f) after step (d), combining the second plant fiber stream with at least a third aqueous stream comprising water to form a second mixture in a second tank, wherein the second mixture is subjected to agitation in the second tank;

g) providing the second mixture to a second separation apparatus;

h) separating a fourth aqueous stream from the second mixture in the second separation apparatus to form a third plant fiber stream comprising grain fiber;

i) recycling at least a first portion of the fourth aqueous stream so that it can be combined with the second plant fiber stream in the second tank;

j) recycling at least a second portion of the fourth aqueous stream to form the first aqueous stream so that it can be combined with the first plant fiber stream in the first tank, (k) after step (i), combining the third plant fiber stream with make-up water to form a third mixture in a third tank, wherein the third mixture is subjected to agitation in the third tank;

(l) providing the third mixture to a third separation apparatus;

(m) separating a fifth aqueous stream from the third mixture in the third separation apparatus to form a fourth plant fiber stream comprising grain fiber;

(n) recycling at least a first portion of the fifth aqueous stream and combining it with the third plant fiber stream in the third tank;

(o) recycling at least a second portion of the fifth aqueous stream to form the third aqueous stream and combining it with the second plant fiber stream in the second tank; and (p) adjusting the flow rate of the make-up water to adjust the concentration of the grain fiber on a dry matter basis in the fourth plant fiber stream, wherein the concentration of plant fiber on a dry matter basis in the third plant fiber stream is greater than the concentration of plant fiber on a dry matter basis in the first plant fiber stream.

16. The method of claim 15, wherein the second aqueous stream comprises starch.

17. The method of claim 1, wherein the first separating apparatus is a first screw press and the second separating apparatus is a second screw press.

18. The method of claim 15, wherein the first separation apparatus is a first screw press, the second separation apparatus is a second screw press, and the third separation apparatus is a third screw press.

* * * * *